United States Patent [19]

Hunt

[11] 4,287,785

[45] Sep. 8, 1981

[54] THROTTLE SETTING DEVICE

[76] Inventor: Robert T. Hunt, 549 E. McKellips, Space 86, Mesa, Ariz. 85203

[21] Appl. No.: 102,891

[22] Filed: Dec. 12, 1979

[51] Int. Cl.[3] ..... G05G 1/08; G05G 5/16

[52] U.S. Cl. ..... 74/488; 74/531; 188/343; 403/371

[58] Field of Search ..... 74/488, 489, 531; 188/343; 403/371

[56] References Cited

U.S. PATENT DOCUMENTS

| | | | |
|---|---|---|---|
| 2,879,673 | 3/1959 | Passman | 74/531 |
| 3,752,006 | 8/1973 | Bartlett | 74/489 |
| 3,782,219 | 1/1974 | Beck et al. | 74/531 |
| 3,982,446 | 9/1976 | Van Dyken | 74/531 X |
| 4,060,008 | 11/1977 | Wilkinson | 74/531 X |
| 4,137,793 | 2/1979 | Sowell | 74/531 X |

FOREIGN PATENT DOCUMENTS

| | | | |
|---|---|---|---|
| 864813 | 1/1953 | Fed. Rep. of Germany | 74/489 |

*Primary Examiner*—Allan D. Herrmann
*Attorney, Agent, or Firm*—Don J. Flickinger

[57] ABSTRACT

An end member positioned against the end of a handle bar is engageable with a throttle sleeve rotatably mounted upon the handle bar. The end member also includes an expansion member residing within the handle. A manually movable expander selectively moves the expansion member into frictional engagement with the inside surface of the handle bar for retaining the throttle sleeve at rotatably selective positions relative the handle bar.

7 Claims, 3 Drawing Figures

THROTTLE SETTING DEVICE

This invention relates to motorized vehicles.

In a further aspect, the present invention relates to vehicles of the type having a handle bar with rotatable means for controlling and regulating the throttle.

More particularly, the instant invention concerns a device for retaining rotatable throttle control means at selective settings.

Various motorized vehicles utilize a handle bar for steering. Generally, the handle bar is substantially U-shaped and terminates with a hand grip at either end. Usually, one of the hand grips is rotatably mounted and used to control the speed of the vehicle.

Exemplary of the foregoing type of vehicle is the well known and popular motorcycle. In accordance with conventional practice, a tubular element termed a throttle sleeve is rotatably mounted upon the handle bar. A linkage, such as a cable, extends between the throttle sleeve and the carburetor of the motor. The throttle setting is regulated in response to rotation of the throttle sleeve. The conventional hand grip encases the throttle sleeve.

Included in the throttle system is a spring or other biasing means for normally urging the throttle closed into the idle speed position. Rotation of the throttle by the operator while regulating the speed of the vehicle, opposes the biasing means. During the intermittent movement and constantly changing speeds associated with travel in congested areas, manipulation of the throttle is not a source of concern to the operator of a motorcycle. However, during highway or freeway cruising for extended distances at constant speeds, holding the hand grip at a set rotated position against the force of the spring is monotonous, strenuous and fatiguing.

In recognition of the problem, the prior art has proposed various devices which purportly provide solution. However, the prior art solutions have not been entirely satisfactorily. While some are cumbersome and inconvenient, others raise issues of safety.

Most prior art devices, of the instant character, require deliberate action in order to disengage. Consequently, the throttle cannot be closed immediately in case of an emergency. Others maintain a constant frictional drag and cannot be completely released.

It would be highly advantageous, therefore, to remedy the deficiencies of the prior art.

Accordingly, it is an object of the present invention to provide an improved throttle setting device, especially adapted for use with vehicles having a handle bar with rotatably mounted throttle control means.

Another object of the invention is the provision of means for retaining the throttle sleeve at selective positions.

Still another object of the invention is to provide a throttle setting device which is readily attachable to conventional motorcycles and other motorized vehicles having rotatable throttle regulating means.

Still another object of this invention is the provision of a throttle setting device which is frictionally engagable.

Yet another object of the invention is to provide a throttle setting device which is quickly and conveniently set or released.

Yet still another object of the present invention is the provision of a throttle setting and retaining device which can be manually overridden in case of emergency.

A further object of the invention is to provide a throttle setting device in which the degree of force of retention is variably controllable.

Still a further object of the invention is the provision of a throttle setting device which is relatively free of encumbersomes or protuberances.

And a further object of the invention is to provide a throttle setting device which is relatively uncomplicated and maintenance free.

And still a further object of the invention is the provision of a throttle setting device of the above type having minimal components and being comparatively inexpensive to manufacture.

Briefly, to achieve the desired objects of the instant invention in accordance with a preferred embodiment thereof, first provided is an end member which is positioned proximate the end of the handle bar and the coaxially rotatably mounted throttle sleeve. Retention means carried by the end member is selectively engageable with the handle bar for stabilizing the end member against rotation.

In accordance with a further embodiment of the invention, the engagement means comprises a plurality of tabs for encircling and gripping the outside surfaces of the throttle sleeves. The engagement may also include a plurality of recesses formed in the throttle sleeve for receiving respective tabs.

Also in accordance with the further embodiment of the invention, the retention means is in the form of an expansion member extending from the end member within the handle bar. A movable expander is used for selectively expanding the expansion member outwardly into frictional contact with the inside surface of the handle bar. More specifically, the expansion member includes a tubular projection which is severed longitudinally to form a plurality of deflectable fingers. The expander includes a generally conical element which is drawn into the tubular projection for urging the fingers outwardly against the inside surface of the handle bar.

The foregoing and further and more specific objects and advantages of the instant invention will become readily apparent to those skilled in the art from the following detailed description thereof taken in conjunction with drawings, in which.

Figure 1:
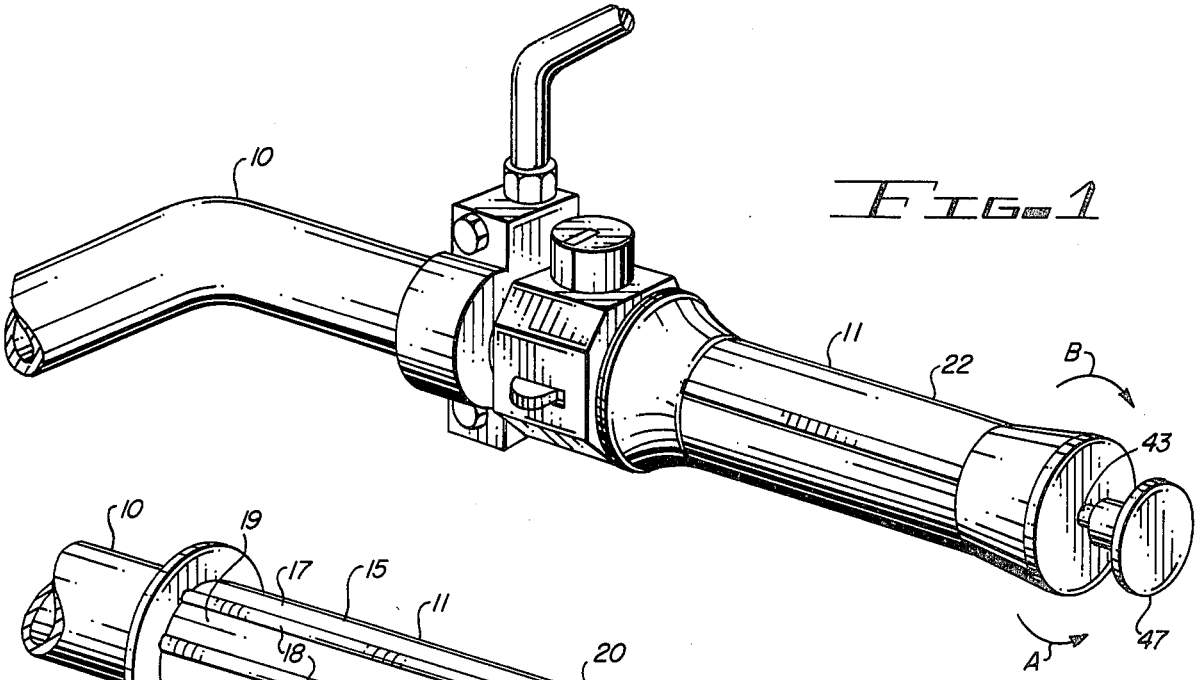
FIG. 1 is a partial perspective view of an end of a typical handle bar including the throttle control means normally associated therewith and having a throttle setting device of the instant invention installed thereon.

Turning now to the drawings in which like reference numerals indicate corresponding elements throughout the several views, attention is first directed to FIG. 1 which illustrates a handle bar 10 including rotatably mounted throttle control means 11. As further seen in FIG. 2, handle bar 10 is generally cylindrical having outside surface 12, inside surface 13 and end 14.

Throttle control means 11 includes tubular throttle sleeve 15 having outer surface 17 and coaxially rotatably mounted upon handle bar 10. Spaced upstanding ribs 18 extend longitudinally along outer surface 17 and form recesses 19 therebetween. In turn annular flange 20 abutts end 14 of handle bar 10. Hand grip 22 coaxially sheathes throttle sleeve 15.

In accordance with conventional practice, a linkage such as a cable extends between throttle sleeve 15 and the fuel intake regulation means, usually the throttle of the carburetor, of the motor. Biasing means, such as a spring, normally urges the throttle into the closed or idle position resulting in rotation of the throttle control means 11 in the direction of arrowed line A. During operation of the vehicle, the operator forcefully opposes the spring rotating throttle means 11 in the direction of arrowed line B to a selected position in accordance with the desired speed.

Generally, handle bar 10 is fabricated of steel, throttle sleeve 15 is molded of rigid plastic and hand grip 22 is formed of rubber-like material. The foregoing description, set forth for purposes of orientation, is based upon an arrangement found on a currently commercially available motorcycle. The description is not intended to be specific but rather typical of the art. Certain modifications and variations are found among manufacturers. For example, throttle sleeves are known which do not include upstanding external ribs.

Figure 2:
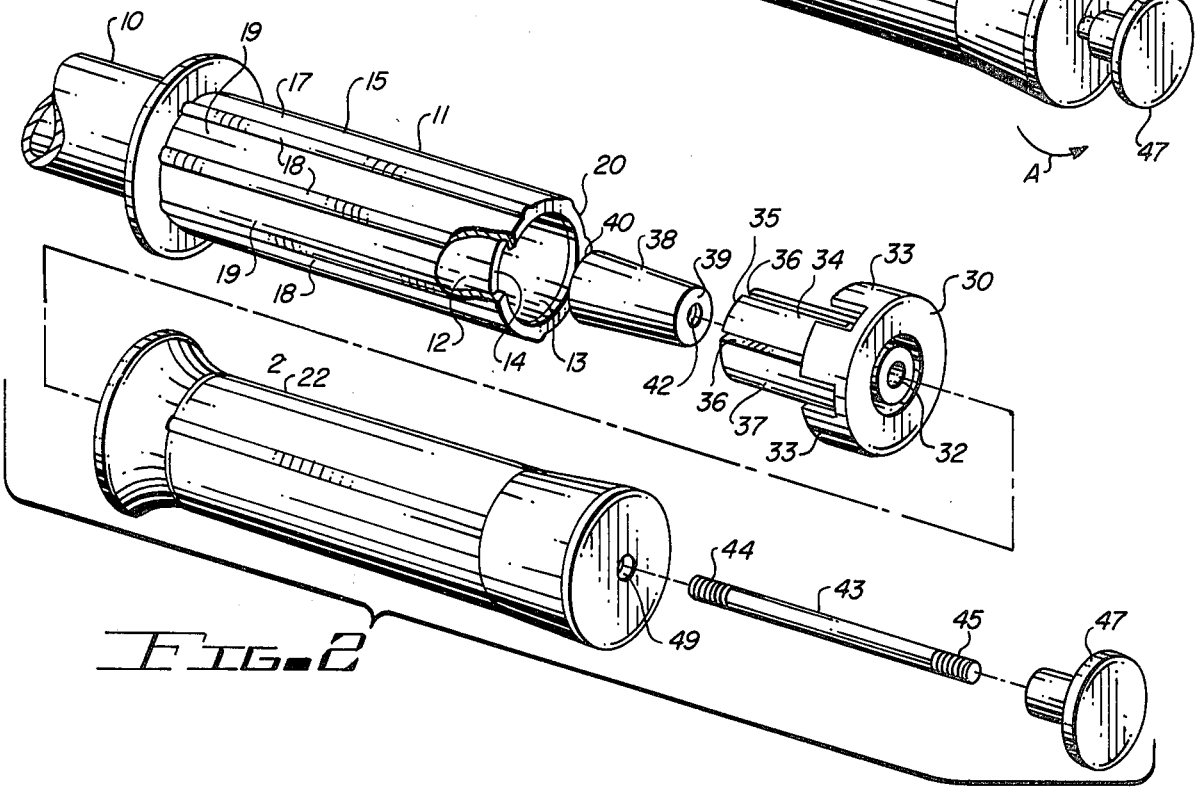
FIG. 2 is an exploded partial perspective view further illustrating the arrangement seen in FIG. 1.

With specific reference to FIG. 2, it is seen that the throttle setting device of the instant invention includes an end member, specifically illustrated as disk 30 having an outside diameter generally corresponding with the outside diameter of throttle sleeve 15 and having a central bore 32 extending therethrough. Engagement means carried by the end member receive and grip the outside surface of throttle sleeve 11. In accordance with the immediate embodiment, the engagement means is in the form of a plurality of tabs 33, each of which is received within a respective recess 19 between associated ribs 18. It is noted that tab 33 has a width generally corresponding to the width of the respective recess 19.

An expansion member in the form of tubular projection 34 having free end 35 also projects from disk 30. Tubular projection 34 is severed longitudinally, as indicated by slots 36 to form fingers 37. Bore 32, tabs 33 and tubular projection 34 are coaxial.

An expander in the form of conical element 38 having convergent end 39 and divergent end 40, includes axially located threaded aperture 42. Stem 43 having first and second threaded ends 44 and 45, respectively, is receivable through bore 32. First threaded end 44 is engageable with threaded aperture 42 of conical element 38. Hand knob 47 is secureable to second threaded end 45.

Assembly and installation is initiated by threadly engaging first end 44 of stem 43 with threaded aperture 42 of conical element 38. Stem 43 is then passed through bore 32 of disk 30 such that the convergent end 39 of conical element 38 enters bore 48 of tubular projection 34, and knob 47 assembled with second end 45 of stem 43. Hand grip 22 is then removed rearwardly from throttle sleeve 15 in accordance with conventional practice utilized for replacing worm or damaged hand grips. Subsequently, tubular projection 34 is entered into handle bar 10 with tabs 33 being received within respective recesses 19 and disk 30 abutting annular flange 20, throttle sleeve 15 in close proximity to end 14 of handle bar 10.

Knob 47 is pulled rearwardly into the set position and then removed. Finally, hand grip 22 is replaced and knob 47 reassembled. It is noted that conventional hand grips as supplied by certain manufacturers have an opening in the end thereof. For hand grips not having an opening, a hole such as illustrated at 49 and generally corresponding to the size of bore 32 is readily drilled or otherwise formed. Finally, after hand grip 22 is replaced with stem 43 projecting from hole 49, hand knob 47 is secured to second threaded end 45.

Figure 3:
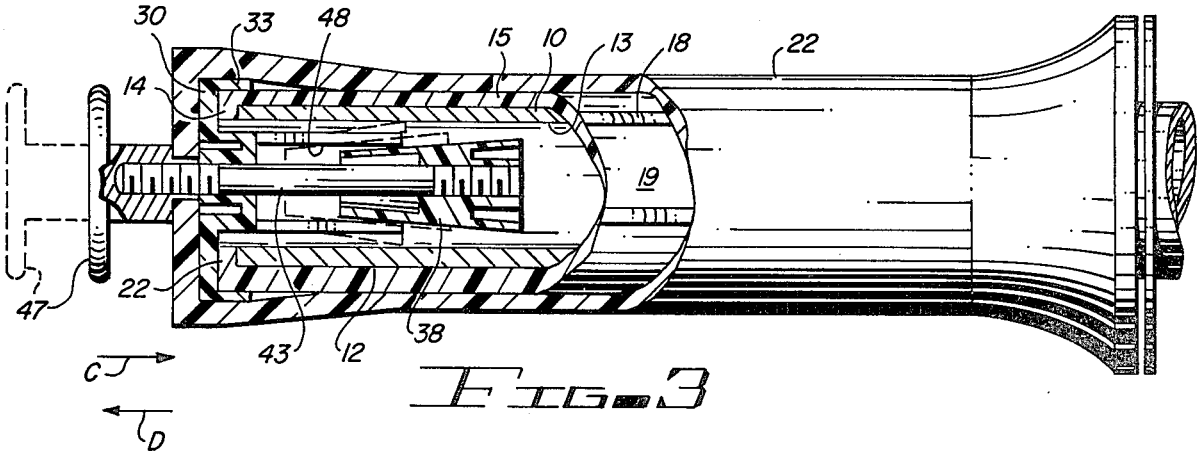
FIG. 3 is an enlarged elevation view of the assembled components of FIG. 2, partially being broken away for purposes of illustration.

Operation of the throttle setting device of the instant invention is exceedingly simple, requiring two convenient manual manipulations. One manipulation is utilized for setting the device, while the other is used for releasing the device. When hand knob 47 is pushed in the direction of arrowed line C, the device assumes the configuration as shown in solid line in FIG. 3. Hand knob 47 abutts the end of hand grip 22 and conical element 38 is extended for relaxation of fingers 37. For setting, hand knob 47 is pulled in the direction of arrowed line D moving convergent end 39 of conical element 38 in a direction toward disk 30. During reciprocal movement of expander, bore 32 acts as a guide for stem 43. The entrance of conical element 38 into tubular projection 34 deflects fingers 37 outwardly into frictional engagement with the inside surface 13 of handle bar 10. The set position is illustrated in broken outline in FIG. 3.

Preferrable, the end element, including disk 30, tabs 33 and tubular projection 34, is integrally molded or fabricated of a material exhibiting characteristics of substantial rigidity and smooth surface finish as typified by certain types of plastic. It is well established that such materials in thin cross-section components exhibits spring-like characteristics. Conical element 38 and hand knob 47 may be fabricated of a similar material while stem 43 is preferrable fabricated of metal. Accordingly, fingers 37 are readily movable between the positions illustrated in FIG. 3 in response to forward and rearward movement of conical element 38. In the expanded position, sufficient frictional engagement exists between inside surface 13 of handle bar 10 and the external surface of fingers 37 to retain the throttle sleeve at the selected rotatable position. However, due to the hard smooth surfaces of handle bar 10 and of the fingers 37, the frictional engagement is not so great as to be readily overcome by the operator of the vehicle during manual rotation of hand grip 22.

Pursuant to the foregoing description, it is apparent that the device of the instant invention is quickly and conveniently installed without the use of special skills or tools. It is equally apparent that the device is conveniently useable, simply requiring a pull to set and a push to release. It is especially important to note that while the device retains the throttle means at the desired setting, it is easily overridden in case of an emergency.

Various modifications and changes to the embodiment herein chosen for purposes of illustration will readily occur to those skilled in the art. For example, some throttle sleeves do not have integral ribs and recesses as shown. In this case, the pressure between the hand grip and the throttle sleeve is sufficient to frictionally retain the engagement means. To the extent that such modifications and variations do not depart from the spirit of the invention, they are intended to be included within the scope thereof which is assessed only by a fair interpretation of the following claims.

Having fully described and disclosed the present invention and alternately preferred embodiments thereof in such clear and concise terms as to enable those skilled in the art to understand and practice the same, the invention claimed is:

1. A throttle setting device for use in combination with a vehicle, which vehicle includes, a cylindrical tubular handle bar having an inside surface and an end, a tubular throttle sleeve having an outside surface coaxially rotatably mounted upon said handle bar, and a hand grip coaxially sheathing said throttle sleeve and rotatable therewith, and for retaining said throttle sleeve at rotatably selective positions relative said handle bar, said throttle control device comprising:

a. an end member positioned proximate the end of said handle bar;

b. engagement means carried by said end member for interlocking said end member with said throttle sleeve; and c. retention means carried by said end member for selectively engaging said handle bar and stabilizing said end member against rotation.

2. The throttle setting device of claim 1, wherein said engagement means includes means for receiving and gripping to outside surface of said throttle sleeve.

3. The throttle setting device of claim 1, wherein said engagement means includes:

a. a recess formed in said throttle sleeve; and b. a tab projecting from said end member and received within said recess.

4. The throttle setting device of claim 1 wherein said retention means includes:

a. an expansion member extending from said end member within said handle bar; and b. an expander for selectively expanding said expansion member outwardly against the inside surface of said handle bar.

5. The throttle setting device of claim 4, wherein:

a. said expansion member includes a tubular projection having a free end and being severed longitudinally from said free end to form deflectable fingers; and b. said expander includes, i. a generally conical element having a convergent end directed toward said end member, and ii. handle means for alternately moving said expander in a first direction toward said end element for deflecting said fingers outwardly into frictional engagement with the inner surface of said handle bar and a second direction away from said end member for relaxation of said fingers from the inner surface of said handle bar.

6. The throttle setting device of claim 5, wherein said handle means includes:

a. guide means extending through said end element;

b. a stem slidable extending through said guide means and having, i. a first end affixed to said expander, and ii. a second end; and c. a hand knob affixed to the second end of said stem.

7. The throttle setting device of claim 5, wherein said fingers have a relatively smooth, low-friction surface for contacting the inside surface of said handle bar.

* * * * *